US006554658B1

(12) United States Patent
Verneau

(10) Patent No.: US 6,554,658 B1
(45) Date of Patent: Apr. 29, 2003

(54) ELECTRICAL CONNECTION DEVICE FOR CONNECTING A MALE CONTACT TO A LOOP FORMED IN A STRIPPED CONDUCTOR

(75) Inventor: Olivier Verneau, Rueil Malmaison (FR)

(73) Assignee: Société Sylea, Montigny le Bretonneux (FR)

( * ) Notice: Subject to any disclaimer, the term of this patent is extended or adjusted under 35 U.S.C. 154(b) by 0 days.

(21) Appl. No.: 09/983,938

(22) Filed: Oct. 26, 2001

(51) Int. Cl.[7] ..... H01R 4/48; H01R 11/03
(52) U.S. Cl. ..... 439/786
(58) Field of Search ..... 439/786, 790, 439/708, 816, 856, 729

(56) References Cited

U.S. PATENT DOCUMENTS

| | | | | |
|---|---|---|---|---|
| 3,644,875 | A | 2/1972 | O'Loughlin | 439/391 |
| 3,864,010 | A | 2/1975 | Wasserlein, Jr. | 439/408 |
| 4,013,332 | A | 3/1977 | Dauser, Jr. | 439/408 |
| 4,124,265 | A | 11/1978 | Turk | 439/403 |
| 4,133,596 | A | 1/1979 | Dauser, Jr. | 439/408 |
| 4,511,200 | A | 4/1985 | Belokin, Jr. | 439/226 |

*Primary Examiner*—Javaid Nasri
(74) *Attorney, Agent, or Firm*—Greenblum & Bernstein, P.L.C.

(57) ABSTRACT

An electrical connection device for a male electrical contact member includes a body with a passage able to contain at one end a conductor bent to form a loop and to receive a clamp for retaining and fixing the loop. The clamp presses on an elastic pusher which presses a male member inserted into the passage against the loop.

17 Claims, 3 Drawing Sheets

ELECTRICAL CONNECTION DEVICE FOR CONNECTING A MALE CONTACT TO A LOOP FORMED IN A STRIPPED CONDUCTOR

BACKGROUND OF THE INVENTION

1. Field of the Invention

The present invention relates to an electrical connection device for a male electrical contact member taking the form of a tongue. taking the form of a tongue.

2. Description of the Prior Art

Electrical connections generally use a male electrical contact member crimped to one end of an electrical conductor and adapted to be inserted into a female member in which it is retained elastically, the combination being accommodated in a passage in a housing.

This necessitates a series of relatively complex operations, and one object of the present invention is to simplify this kind of electrical connection device.

SUMMARY OF THE INVENTION

The invention provides a device including a housing member incorporating a passage with a slot at one end for inserting a male member, and in which, at the end opposite the slot, the passage has an opening for inserting a clamp, an arrangement for guiding and an arrangement for locking the clamp being provided in the passage so that the clamp is perpendicular to the slot, the clamp taking the form of a plate having a cut-out opening onto one of its edges intended to face toward the end of the slot for inserting the male member and delimiting two branches, one of which includes a member for retaining a loop formed in a stripped conductor inserted into the passage and the other of which includes an elastic pusher adapted to press the male member against the loop in the conductor.

This kind of device is inexpensive, easy to use and quick to fit because it suffices to insert the loop and then the clamp into the passage to produce a female electrical contact member.

According to one constructional feature, the housing member has, in the passage and in the vicinity of the end with the slot for inserting the male member, an abutment for retaining the loop in the conductor and the shoulder of the corresponding branch of the clamp faces toward the abutment. Thus fitting and fixing the loop in the conductor in the passage are particularly simple.

To press the male member engaged between the branches of the clamp against the loop with some force, the branch constituting the elastic pusher has, on the same side as the other branch, a boss that is higher up than the shoulder of the other branch.

According to another constructional feature, the passage in the housing member includes at least one catch adapted to cooperate with the edge of the plate constituting the clamp opposite that onto which the cutout opens.

According to another feature, the passage includes two first grooves for guiding the conductor and two grooves for guiding the clamp in a plane perpendicular to the first grooves.

Finally, the clamp can be made from an elastic material that is a good conductor of electricity.

The invention also provides for an electrical connection device for connecting a male electrical contact member to a loop formed in a stripped conductor, wherein the device comprises a housing member which houses a clamp. The housing member has a slot arranged at one end of the housing member. The slot is configured to receive the male electrical contact member. An opening is arranged on an other side of the housing member, whereby the other side is opposite the one end having the slot. The opening is configured to receive the clamp. A passage for housing the clamp is defined between the one end and the other end. A guiding arrangement guides the clamp in the housing member. A locking arrangement locks the clamp in the passage. The clamp is arranged perpendicular to the slot. The clamp comprises a plate having two branches and a cut-out opening which is configured to receive the male electrical contact member. One of the two branches includes a member which retains the loop formed in the stripped conductor. The other of the two branches is configured to elastically press the male member against the loop formed in the stripped conductor when the male electrical contact member is arranged in the slot.

The male electrical contact member may comprise a tongue. The housing member may comprise an abutment arranged in a vicinity of the slot, the abutment being configured to retain the loop formed in the stripped conductor. The member which retains the loop formed in the stripped conductor may comprise a shoulder. The other of the two branches may comprise a boss. The member which retains the loop formed in the stripped conductor may comprise a shoulder that is arranged at a first distance from the other end of the housing member, the other of the two branches may comprise a boss which is arranged at a second distance from the other end of the housing member, and the second distance may be greater than the first distance.

The locking arrangement may comprise a catch. The catch may be disposed inside the passage. The catch may engage an end of the clamp that is opposite an end of the clamp that has the cut-out opening. The passage may include two first grooves for guiding the loop formed in the stripped conductor. The guiding arrangement may comprise two second grooves for guiding the clamp. The two second grooves may be oriented in a plane that is perpendicular to the two first grooves. The passage may include grooves for guiding the loop formed in the stripped conductor and wherein the guiding arrangement comprises grooves for guiding the clamp. The clamp may comprise one of an elastic material, a plastic material, a metal and a material that is a good conductor of electricity.

The invention also provides for an electrical connection device for connecting an electrical contact member to a loop formed in a stripped conductor, wherein the device comprises a housing member which houses a clamp. The housing member comprises a slot arranged at a first end of the housing member. The slot is configured to receive the electrical contact member. An opening is arranged on a second end of the housing member. The opening is configured to receive the clamp. A passage for housing the clamp is defined between the first and second ends. A guiding arrangement guides the clamp in the housing member. A locking arrangement locks the clamp in the passage. The clamp is arranged perpendicularly to the slot. The clamp comprises a plate having a first branch, a second branch and an opening which is configured to receive the electrical contact member. The first branch has a shoulder which retains the loop formed in the stripped conductor. The second branch has a boss which elastically presses the electrical contact member against the loop formed in the stripped conductor when the electrical contact member is inserted into the slot and the opening of the clamp.

The invention also provides for an electrical connection device for connecting an electrical contact member to a loop formed in a stripped conductor, wherein the device comprises a housing member which houses a clamp. The housing member comprises a first end having a slot. The slot is configured to receive the electrical contact member. An opening is arranged on a second end of the housing member. The opening is configured to receive the clamp. A passage for housing the clamp in the housing member is included. First guiding grooves guide the clamp within the housing member. Second guiding grooves guide the loop formed in a stripped conductor within the housing member. A locking arrangement locks the clamp in the passage. The clamp is arranged perpendicularly to the slot. The clamp comprises a plate having a first branch, a second branch and an opening which is configured to receive the electrical contact member. The first branch retains the loop formed in the stripped conductor. The second branch elastically presses the electrical contact member against the loop formed in the stripped conductor when the electrical contact member is inserted into the slot and the opening of the clamp.

The invention will now be described in more detail with reference to one particular embodiment provided by way of example only and shown in the accompanying drawings.

DETAILED DESCRIPTION OF THE INVENTION

Figure 7:
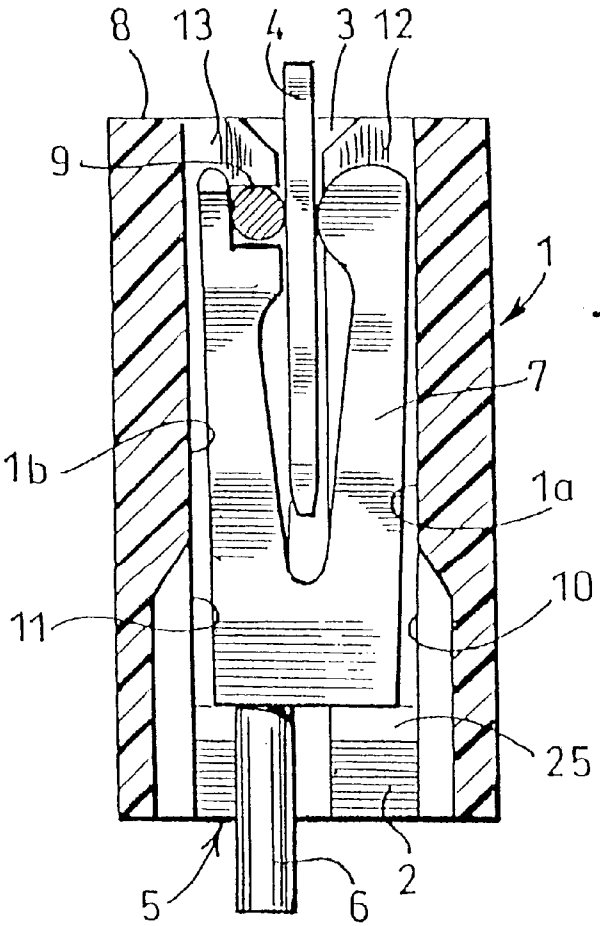
FIG. 7 is a sectional view corresponding to FIG. 6, showing the male member inserted into the clamp.
Figure 1:
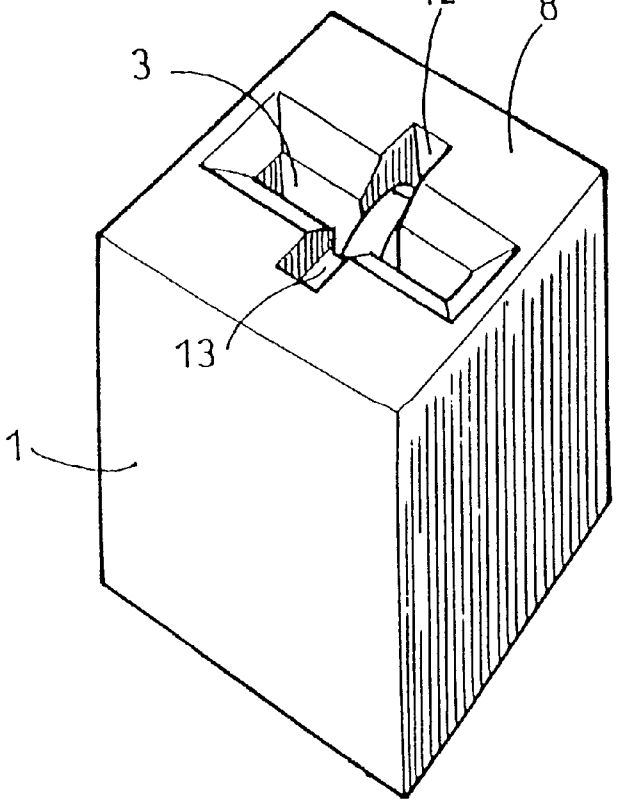
FIG. 1 is a perspective view of a device in accordance with the invention.
Figure 2:
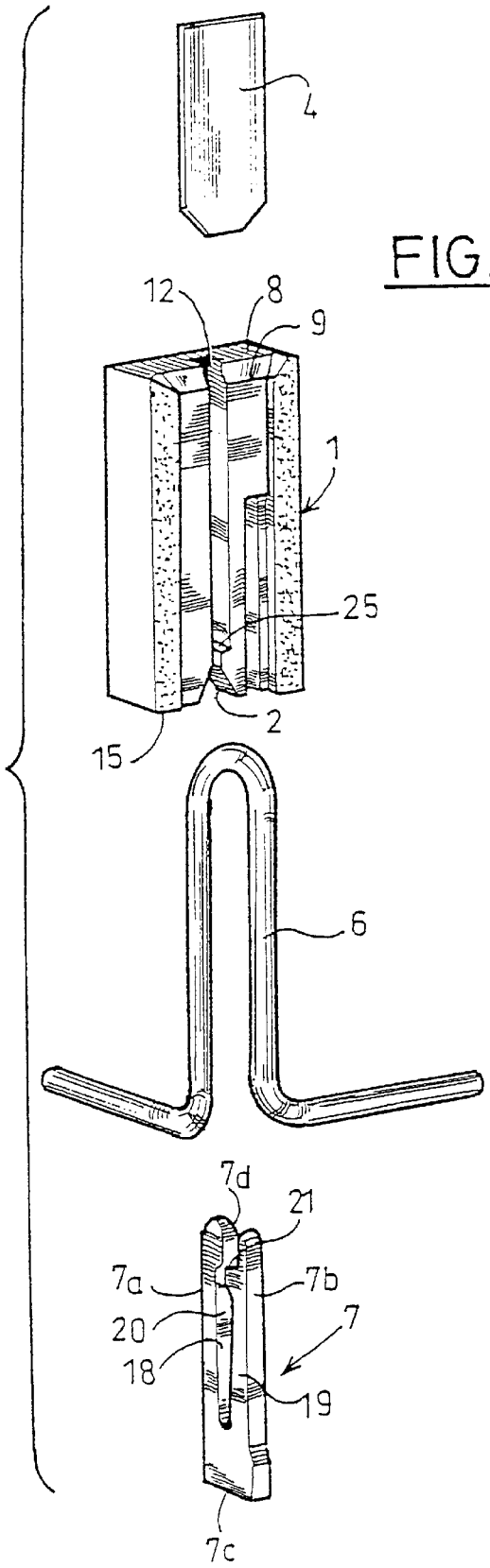
FIG. 2 is an exploded perspective view of the device shown in FIG. 1.
Figure 3:
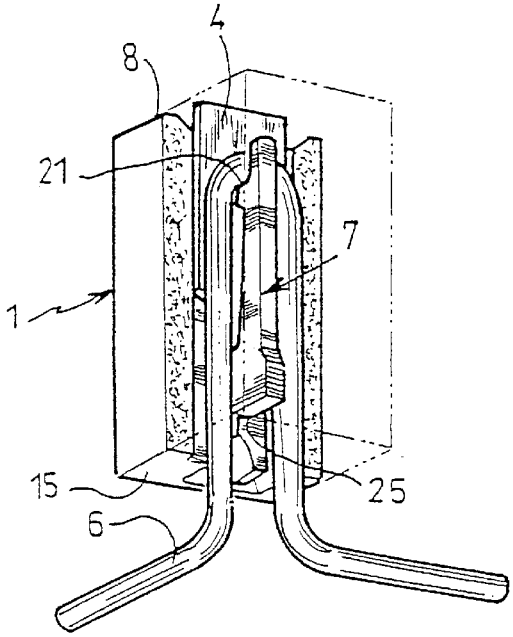
FIG. 3 is a partly cut away perspective view of the assembled device.
Figure 5:
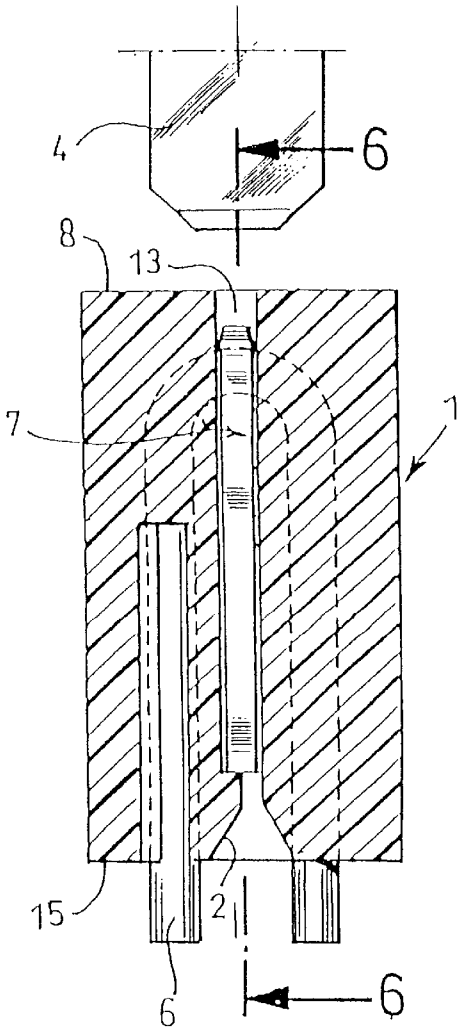
FIG. 5 is a view in section taken along the line 5—5 in FIG. 6.
Figure 6:
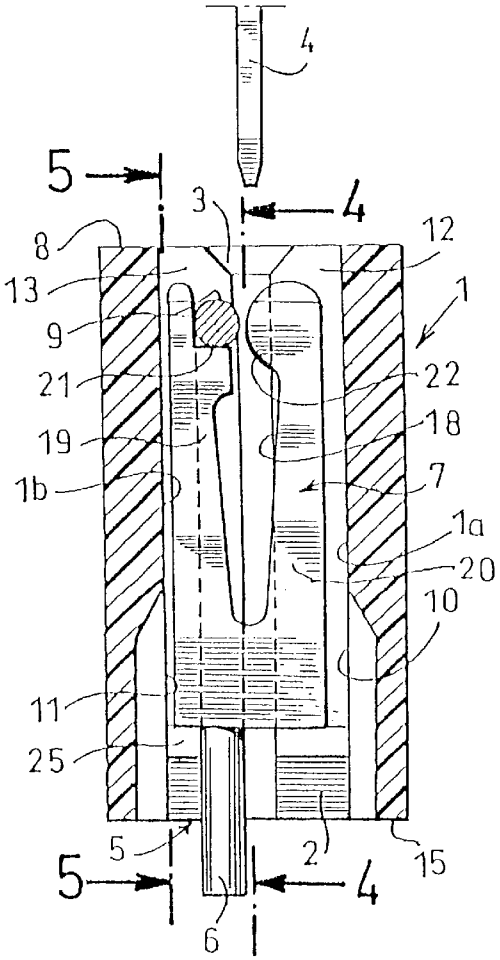
FIG. 6 is a view in section taken along the line 6—6 in FIG. 5.
Figure 4:
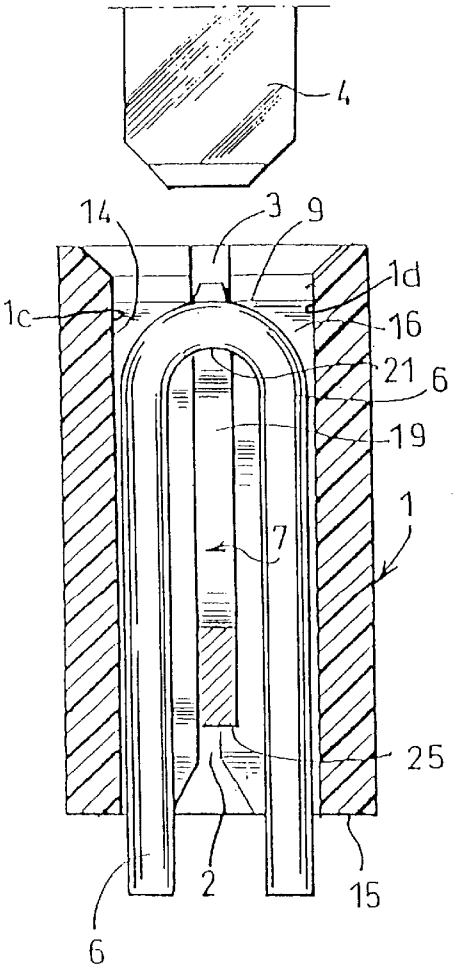
FIG. 4 is a view in section taken along the line 4—4 in FIG. 6.

The connection device shown in the figures includes a housing member 1 pierced by a passage 2 having at one end 8 a slot 3 for inserting a male tongue 4 and at the other end 15 an opening 5 for inserting a conductor 6 and a clamp 7.

The passage 2 has grooves 10 and 11 for the clamp 7 on two opposite inside walls 1*a* and 1*b* and opening into openings 12 and 13 at the end 8, which incorporates abutments 9.

Grooves 14 and 16 for guiding the conductor 6 on the other two inside walls 1*c* and 1*d* of the passage 2 are situated in a common plane perpendicular to a plane passing through the grooves 10 and 11.

The clamp 7 is made of an elastic plate, of metal and possibly of a material that is a good conductor of electricity, and has a generally rectangular shape with two longer sides 7*a* and 7*b* and two shorter sides 7*c* and 7*d*. A cut-out 18 extending from the shorter side 7*d* delimits two branches 19 and 20. The branch 19 has a shoulder 21 near its free end and the branch 20 constitutes an elastic pusher and has a boss 22 near its free end and higher up than the shoulder 21.

The depth of the shoulder 21 is less than the section of the stripped conductor 6 and the boss 22, when in its relaxed position, is in the vicinity of the conductor 6.

Two catches 25 for immobilizing the clamp 7 in the grooves 10 and 11 are molded at the end 15 of the housing member 1.

As shown in the figures, the conductor 6 is bent in two to form a U-shaped loop. The outside face of the core of the U-shaped loop bears against the abutments 9. The clamp 7 is inserted from the end 15 into the grooves 10 and 11. The loop of the conductor 6 cooperates with the shoulder 21. The clamp 7 is immobilized by the catches 25, which bear against the edge of the shorter side 7*c*.

Note that the distance between the bottoms of the grooves 10 and 11 is slightly greater than the width of the clamp 7 so that there is some elastic play between the branches 19 and 20 when the tongue 4 inserted into the slot 3 lies between the loop in the conductor 6 and the boss 22.

The figures show a unitary housing member, but the housing could take the form of a body including a series of passages 2.

Of course, the invention is not limited to the embodiment just described and shown, to which many modifications of detail can be made without departing from the scope of the invention.

What is claimed is:

1. An electrical connection device for connecting a male electrical contact member to a loop formed in a stripped conductor, the device comprising:

a housing member which houses a clamp;

the housing member comprising a slot arranged at one end of the housing member;

the slot being configured to receive the male electrical contact member;

an opening arranged on an other side of the housing member, the other side being opposite the one end having the slot;

the opening being configured to receive the clamp;

a passage for housing the clamp being defined between the one end and the other end;

a guiding arrangement which guides the clamp in the housing member;

a locking arrangement which locks the clamp in the passage;

the clamp being arranged perpendicularly to the slot;

the clamp comprising a plate having two branches and a cut-out opening which is configured to receive the male electrical contact member;

one of the two branches includes a member which retains the loop formed in the stripped conductor; and the other of the two branches being configured to elastically press the male member against the loop formed in the stripped conductor when the male electrical contact member is arranged in the slot.

2. The electrical connection device of claim 1, wherein the male electrical contact member comprises a tongue.

3. The electrical connection device of claim 1, wherein the housing member comprises an abutment arranged in a vicinity of the slot, the abutment being configured to retain the loop formed in the stripped conductor.

4. The electrical connection device of claim 1, wherein the member which retains the loop formed in the stripped conductor comprises a shoulder.

5. The electrical connection device of claim 4, the other of the two branches comprises a boss.

6. The electrical connection device of claim 1, the other of the two branches comprises a boss.

7. The electrical connection device of claim 1, wherein the member which retains the loop formed in the stripped conductor comprises a shoulder that is arranged at a first distance from the other end of the housing member, wherein the other of the two branches comprises a boss which is arranged at a second distance from the other end of the housing member, and wherein the second distance is greater than the first distance.

8. The electrical connection device of claim 1, wherein the locking arrangement comprises a catch.

9. The electrical connection device of claim 8, wherein the catch is disposed inside the passage.

10. The electrical connection device of claim 8, wherein the catch engages an end of the clamp that is opposite an end of the clamp that has the cut-out opening.

11. The electrical connection device of claims 1, wherein the passage includes two first grooves for guiding the loop formed in the stripped conductor.

12. The electrical connection device of claim 11, wherein the guiding arrangement comprises two second grooves for guiding the clamp.

13. The electrical connection device of claim 12, wherein the two second grooves are oriented in a plane that is perpendicular to the two first grooves.

14. The electrical connection device of claim 1, wherein the passage includes grooves for guiding the loop formed in the stripped conductor and wherein the guiding arrangement comprises grooves for guiding the clamp.

15. The electrical connection device of claim 1, wherein the clamp comprises one of an elastic material, a plastic material, a metal and a material that is a good conductor of electricity.

16. An electrical connection device for connecting an electrical contact member to a loop formed in a stripped conductor, the device comprising:

a housing member which houses a clamp;

the housing member comprising a slot arranged at a first end of the housing member;

the slot being configured to receive the electrical contact member;

an opening arranged on a second end of the housing member;

the opening being configured to receive the clamp;

a passage for housing the clamp being defined between the first and second ends;

a guiding arrangement which guides the clamp in the housing member;

a locking arrangement which locks the clamp in the passage;

the clamp being arranged perpendicularly to the slot;

the clamp comprising a plate having a first branch, a second branch and an opening which is configured to receive the electrical contact member;

the first branch having a shoulder which retains the loop formed in the stripped conductor; and the second branch having a boss which elastically presses the electrical contact member against the loop formed in the stripped conductor when the electrical contact member is inserted into the slot and the opening of the clamp.

17. An electrical connection device for connecting an electrical contact member to a loop formed in a stripped conductor, the device comprising:

a housing member which houses a clamp;

the housing member comprising a first end having a slot;

the slot being configured to receive the electrical contact member;

an opening arranged on a second end of the housing member;

the opening being configured to receive the clamp;

a passage for housing the clamp in the housing member;

first guiding grooves which guide the clamp within the housing member;

second guiding grooves which guide the loop formed in a stripped conductor within the housing member;

a locking arrangement which locks the clamp in the passage;

the clamp being arranged perpendicularly to the slot;

the clamp comprising a plate having a first branch, a second branch and an opening which is configured to receive the electrical contact member;

the first branch retaining the loop formed in the stripped conductor; and the second branch elastically pressing the electrical contact member against the loop formed in the stripped conductor when the electrical contact member is inserted into the slot and the opening of the clamp.

* * * * *